United States Patent [19]

Nakamura

[11] Patent Number: 4,600,315

[45] Date of Patent: Jul. 15, 1986

[54] WHOLE BODY SWINGABLE CLOCK

[75] Inventor: Norihiko Nakamura, Tokyo, Japan

[73] Assignee: Rhythm Watch Co., Ltd., Tokyo, Japan

[21] Appl. No.: 603,631

[22] Filed: Apr. 25, 1984

[30] Foreign Application Priority Data

Apr. 28, 1983 [JP] Japan ..... 58-64421[U]
Apr. 28, 1983 [JP] Japan ..... 58-64422[U]

[51] Int. Cl.[4] ..... G04B 1/00
[52] U.S. Cl. ..... 368/135; 368/179
[58] Field of Search ..... 368/179, 135, 136

[56] References Cited

U.S. PATENT DOCUMENTS

| | | | |
|---|---|---|---|
| 2,292,139 | 8/1942 | Loew | 368/135 |
| 3,798,891 | 3/1974 | Sovenyhazi | 368/136 |
| 4,468,132 | 8/1984 | Nakamura | 368/179 |
| 4,525,078 | 6/1985 | Chu | 368/165 |

FOREIGN PATENT DOCUMENTS

| | | | |
|---|---|---|---|
| 49972 | 6/1981 | Japan | 368/179 |

*Primary Examiner*—Bernard Roskoski
*Attorney, Agent, or Firm*—Koda and Androlia

[57] ABSTRACT

A whole body swingable clock which includes a clock body swingingly supported on the pendulum fulcrum, an additional pendulum contained in the clock body to swing the clock body by means of movement of gravity center position, said clock body containing a clock drive mechanism having a clock drive gear train to indicate a certain time and an additional pendulum drive mechanism having an additional pendulum drive gear train to drive the additional pendulum, the additional pendulum drive gear train prepared with an escape wheel, a pallet fork which engages with the escape wheel to swing and is connected to the additional pendulum and a urging means which provides the predetermined rotating force to the escape wheel so that the rotation of the escape wheel enables the engaging conditions between the escape wheel and the pallet fork to be changed to swing the pallet fork and the additional pendulum connected thereto and further the whole clock body, wherein the clock drive gear train and the additional pendulum drive gear train are arranged to be linked with each other so that the clock drive gear train can wind up the urging means to accumulate the urging force, and both of these two gear trains can be driven by a single drive means, and further wherein a time correcting wheel is installed between the clock drive gear train and the additional pendulum drive gear train so that the time correcting wheel can be geared with both of these gear trains, and the rotation of the time correcting wheel enables a time to be corrected and the urging means of the additional pendulum drive mechanism to be wound up for accumulation of the initial urging force.

5 Claims, 6 Drawing Figures

WHOLE BODY SWINGABLE CLOCK

BACKGROUND OF THE INVENTION

1. Field of The Invention

This invention relates to a whole body swingable clock, and more particularly to the whole body swingable clock which swings its whole clock body by an additional pendulum drive mechanism.

2. Description of The Prior Art

In recent years, for the purpose of decoration there has been practically and widely used a whole body swingable clock which swings its whole clock body on a pendulum fulcrum.

In this kind of the whole body swingable clock, the whole clock body is swingingly supported on the pendulum fulcrum of the fixed supporting member, and, in ordinary cases, a knife edge is supported in a V-groove of the fixed supporting member. The fixed supporting member mentioned above consists of a stationary receiving plate fixed to the wall or a receiving plate held by a hand of a statue of queen. In order to swing the whole clock body an additional pendulum is swingingly contained in the inside of the clock body, and movement of the gravity center position in the clock body by means of the swing of the additional pendulum can continue the swinging movement of the whole clock body.

In the whole body swingable clock in the prior art, however, in the clock body a clock drive mechanism indicating a certain time is independently and separately installed from the additional pendulum drive mechanism which drives the additional pendulum, and two pieces of the driving means must be prepared to drive these two mechanisms, which causes the clock body to become thick and large sized.

Furthermore, in the whole body swingable clock in the prior art, there is such a problem that the initial swing of the clock body must be started by manual operation and its starting operation becomes complicated.

SUMMARY OF THE INVENTION

Accordingly, it is an object of the present invention to provide a whole body swingable clock which can be driven by a single drive means with the basis of a link between the clock drive mechanism and the additional pendulum drive mechanism, and designed in a thin type and a small size.

Furthermore, it is another object of the present invention to provide the whole body swingable clock in which rotation of a time correcting wheel to correct a time winds up to accumulate an initial urging force in a urging means of the additional pendulum drive mechanism so that the whole clock body can be started to swing by itself.

In keeping with the teachings of the present invention, the objects are accomplished with the whole body swingable clock which incudes a clock body swingingly supported on the pendulum fulcrum, an additional pendulum contained in the clock body to swing the clock body by means of movement of gravity center position, said clock body containing a clock drive mechanism having a clock drive gear train to indicate a certain time and an additional pendulum drive mechanism having an additional pendulum drive gear train to drive the additional pendulum, the additional pendulum drive gear train prepared with an escape wheel, a pallet fork which engages with the escape wheel to swing and is connected to the additional pendulum and a urging means which provides the predetermined rotating force to the escape wheel so that the rotation of the escape wheel enables the engaging conditions between the escape wheel and the pallet fork to be changed to swing the pallet fork and the additional pendulum connected thereto and further the whole clock body, wherein the clock drive gear train and the addtional pendulum drive gear train are arranged to be linked with each other so that the clock drive gear train can wind up the urging means to accumulate the urging force, and both of these two gear trains can be driven by a single drive means, and further wherein a time correcting wheel is installed between the clock drive gear train and the addtional pendulum drive gear train so that the time correcting wheel can be geared with both of these gear trains, and the rotation of the time correcting wheel enables a time to be corrected and the urging means of the additional pendulum drive mechanism to be wound up for accumulation of the initial urging force.

DETAILED DESCRIPTION OF THE EMBODIMENT

Figure 1:
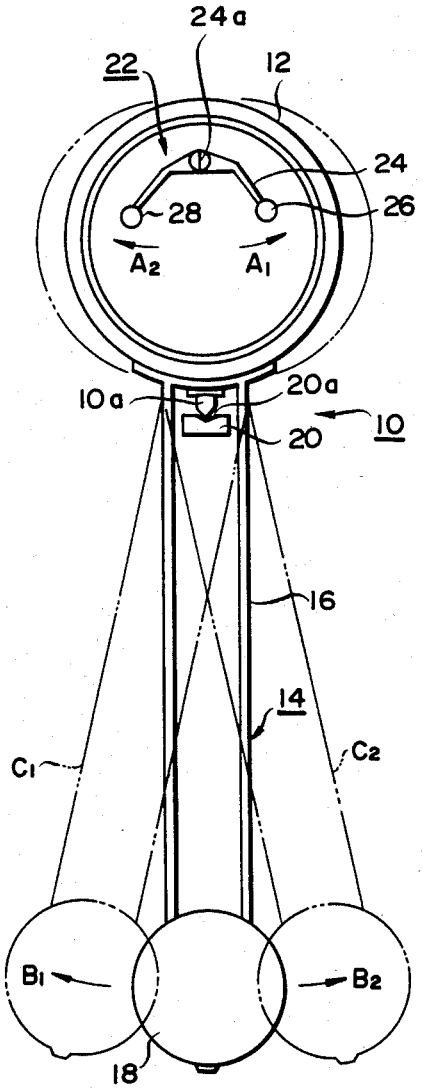
FIG. 1 is a schematic illustration of a whole body swingable clock in accordance with the teachings of the present invention.

Referring more particularly to the drawings, FIG. 1 is a schematic illustration of a whole body swingable clock in accordance with the teachings of the present invention.

In FIG. 1, a clock body 10 swingingly supported on a pendulum fulcrum has a time indicating section 12 in its upper section and a pendulum 14 in its lower section which solidly swings together with the time indicating section 12. The pendulum 14 consists of a pendulum rod 16 and a pendulum bob 18 which is fixed to the low end of the pendulum rod 16. The clock body 10 mentioned above is swingingly supported on the pendulum fulcrum of a fixed support member 20. A knife edge **10*a* of the clock body 10 is supported in a V-groove 20*a* of the fixed support member 20**.

In order to swing the clock body 10 an additional pendulum is swingingly contained in the inside of the clock body 10. This additional pendulum 22 consists of an additional pendulum arm 24 which is swingingly supported on a additional pendulum fulcrum **24*a* and additional pendulum bobs 26 and 28 which are fixed to two ends of the additional pendulum 24. When the additional pendulum 22 swings toward the direction of arrow $A_1$, the movement of gravity center position in the clock body 10 swings the clock body 10 toward the direction of arrow $B_1$, and the clock body 10 is put in a state shown with the two dot chain line $C_1$. On the other hand, when the additional pendulum 22 swings toward the direction of arrow $A_2$, the movement of gravity center position in the clock body 10 swings the clock body 10 toward the direction of arrow $B_2$ and the clock body 10** is put in a state shown with the two dot chain line $C_2$.

Accordingly, it is understood that the swings of the additional pendulum 22 move the gravity center position of the clock body 10 so that the clock body 10 can continue its swinging movement.

Figure 2:
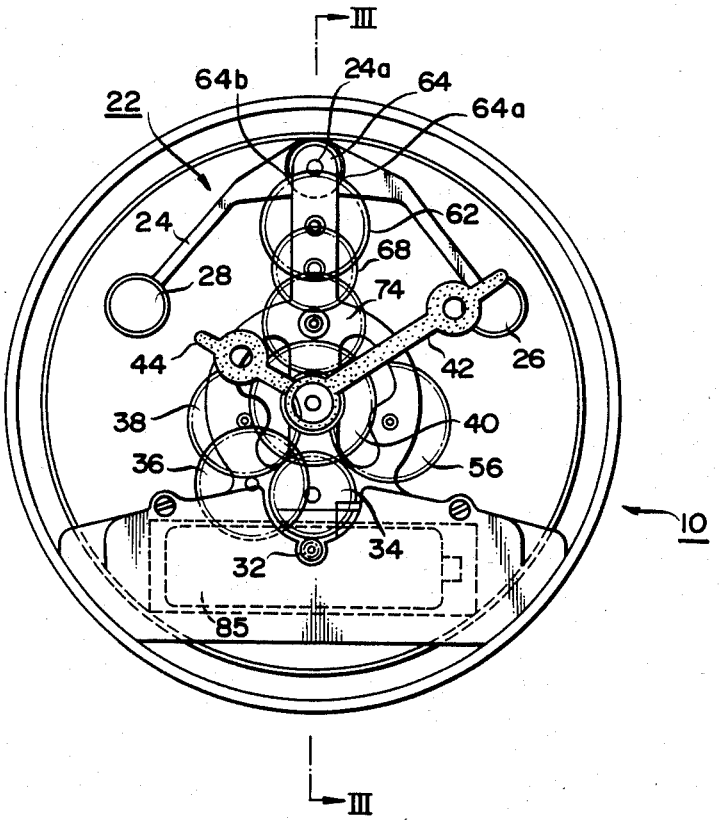
FIG. 2 is an illustration showing a clock body of the whole body swingable clock according to an embodiment of the present invention.
Figure 3:
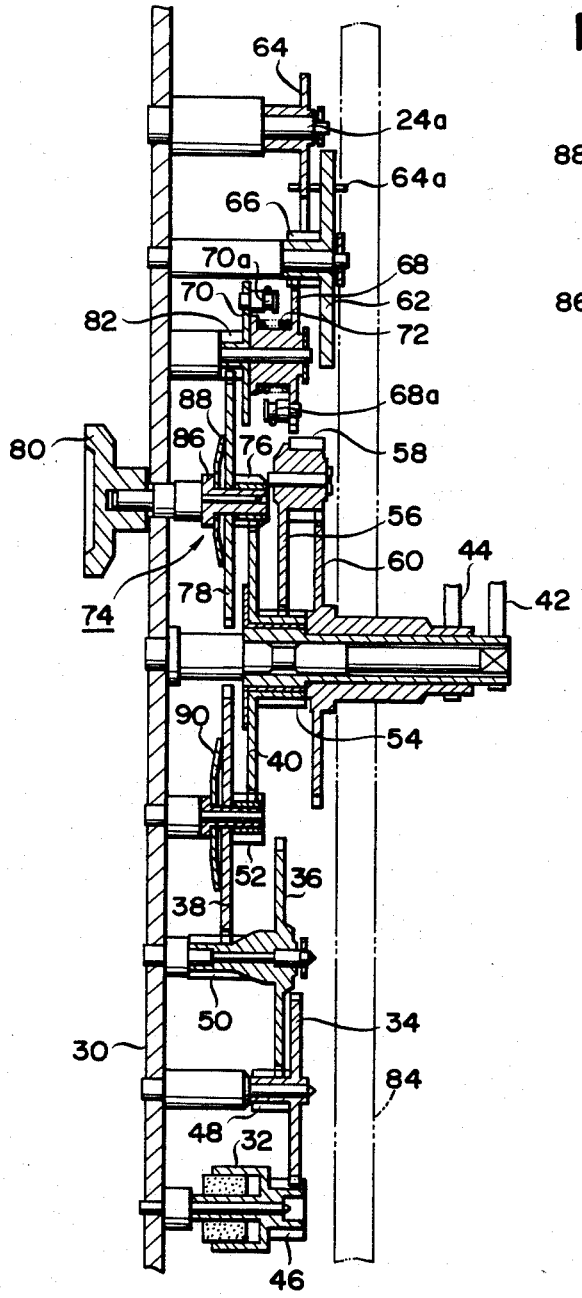
FIG. 3 is a sectional view taken on line III—III of FIG. 2.

In FIG. 2 shown therein is a clock portion of the whole body swingable clock in accordance with an embodiment of the present invention, and its sectional view is illustrated in FIG. 3. A clock drive mechanism indicating a certain time and an additional pendulum drive mechanism driving the additional pendulum are installed in the clock body 10 mentioned above.

Firstly, the clock drive mechanism is hereinafter described.

A rotor 32 is installed on a clock plate 30 as a drive means, and rotation of the rotor 32 is reduced and transmitted to a minute hand wheel 40 through a fifth wheel 34, a fourth wheel 36 and a third wheel 38 so that a minute hand 42 and an hour hand 44 can revolve to indicate a certain time. Furthermore, a clock drive gear train includes the fifth wheel 34, the fourth wheel 36, the third wheel 38 and the minute hand wheel 40. In other words, a rotor pinion 46 attached to the rotor 32 is geared with the fifth wheel 34, a fifth wheel pinion 48 coaxially attached to this fifth wheel 34 is geared with the fourth wheel 36, a fourth wheel pinion 50 coaxially attached to this fourth wheel 36 is geared with the third wheel 38, and a third wheel pinion 52 coaxially attached to this third wheel 38 is geared with the minute hand wheel 40. Furthermore, a minute hand wheel pinion 54 coaxially and solidly formed with the minute hand wheel 40 is geared with a minute wheel 56, and a minute wheel pinion 58 coaxially attached to this minute wheel 56 is geared with an hour hand wheel 60. Rotation of the rotor 32 is reduced and transmitted to the minute hand wheel 40 and the minute hand 42 revolves in accordance with the rotation of this minute hand wheel 40. On the other hand, the rotation of the minute hand wheel 40 is reduced by the minute wheel 56 and transmitted to the hour hand wheel 60.

Accordingly, in the clock drive mechanism, since the rotation of the rotor 32 is reduced and transmitted through the fifth wheel 34, the fourth wheel 36 and the third wheel 38 to rotate the minute hand wheel 40 and the hour hand wheel 60, there revolves the minute hand 42 coaxially fixed to the minute hand wheel 40 and further the hour hand 44 coaxially fixed to the hour hand wheel 60 so that a certain time can be indicated.

Secondly, the gear train of the additional pendulum drive mechanism is hereunder described.

The additional pendulum drive gear train includes an escape wheel 62 having teeth around its circumference and a pallet fork 64 which engages with the escape wheel 62 to swing and is connected to the additional pendulum 22. The pallet fork 64 has two pellet fork pins **64*a* and 64*b* fixed thereto and extended therefrom so that these two pins 64*a* and 64*b* can engage with the escape wheel 62, and the swings of the additional pendulum 22 can swing the pallet fork 64 to advance the escape wheel 62** by one tooth by one tooth.

In order to provide a predetermined rotating force to the escape wheel 62 mentioned above, an escape wheel pinion 66 is coaxially attached to the escape wheel 62 and geared with a transmission wheel 68, which further has another coaxial transmission wheel 70, and a urging means is inserted between these two transmission wheels 68 and 70, a spring 72 for example. In other words, the spring 72 is fastened on one end to a pin **68*a* which is fixed to the transmission wheel 68, and on the other end to a pin 70*a* which is fixed to the transmission wheel 70 so that the rotation of the transmission wheel 70 winds up the spring 72 and the accumulated urged torque of the spring 72 is increased and transmitted to the escape wheel 62 through the transmission wheel 68 and the escape wheel pinion 66. The predetermined rotating force is thus provided to the escape wheel 62**.

Accordingly, the swings of the additional pendulum 22 (the pallet fork 64) changes the engaging conditions between the escape wheel 62 and the pallet fork 64. Since this escape wheel 62 is provided the predetermined rotating force by the spring 72, the swinging movement of the pallet fork 64, that is, the additional pendulum 22 can be continued on.

As mentioned hereinabove, in the additional pendulum drive mechanism, there changes the engaging conditions between the escape wheel 62 and the pallet fork 64, which makes the pallet fork 64 swing, so that the additional pendulum 22 connected to this pallet fork 64 swings and has the clock body 10 to continue its swinging movement as is shown in FIG. 1.

The present invention is characterized in that both of the clock drive gear train and the additional pendulum drive gear train about which were hereinabove described are arranged to be linked with each other, and the clock drive gear train winds up the urging means to accumulate the urging force, as described above, and further a single drive means can drive both of these two gear trains. Moreover, in this embodiment, a time correcting wheel 74 is prepared between the clock drive gear train including the fifth wheel 34, the fourth wheel 36, the third wheel 38 and the minute hand wheel 40, and the additional pendulum drive gear train including the escape wheel 62, the pallet fork 64 and the transmission wheels 68 and 70 so that the time correcting wheel 74 can be geared with both of these two gear trains to link them with each other. The time correcting wheel 74 includes an intermediary wheel pinion 76 which is geared with the minute hand wheel pinion 76, an intermediary wheel 78 which is coaxially installed with this intermediary wheel pinion 76 and a time correcting knob 80 which is installed on the opposite side from the intermediary wheel pinion 76 with regard to the clock plate 30, and the intermediary wheel 78 is geared with a transmission wheel pinion 82 which is coaxially attached to the transmission wheel 70 mentioned above.

Accordingly, the time correcting wheel 74 can link and arrange the clock drive gear train and the additional pendulum drive gear train together, and the clock drive gear train can wind up the spring 72 mentioned above to accumulate the urging force, and further the single drive means can drive both of these two gear trains. In other words, the rotation of the rotor 32 is reduced and transmitted to the minute hand wheel 40 through the fifth wheel 34, the fourth wheel 36 and the third wheel 38, and a certain time is indicated. Furthermore, since the rotation of the minute hand wheel 40 is increased and transmitted to the additional pendulum drive gear train by the time correcting wheel 74 which is geared with the minute hand wheel 40 and the spring 72 is wound up to accumulate the urging force, the swinging movement of the additional pendulum (the pallet fork 64) can be continued on.

As described heretofore, according to the composition of the embodiment, the linked arrangement of the clock drive gear train with the additional pendulum drive gear train by means of the time correcting wheel 74 enables the spring 72 to be wound up for accumulation of the urging force and both of these two gear trains can be driven by the single rotor 32. The linked arrangement of these two gear trains can accomplish the design of the clock body 10 in a thin type and a small size.

Moreover, in this embodiment, since the clock drive gear train and the additional pendulum drive gear train are supported their shafts on the one side by the clock plate 30 and a supplementary plate 84 covers over their open side, it is further possible to accomplish the design of the clock body 10 in a thin type and a small size. The above mentioned supplementary plate 84 consists of a transparent plate composing a clock dial plate. Since both of these two gear trains are made of metal, and can be seen through the supplementary plate 84 (the transparent plate) from the outside, a user can enjoy a novel design as well as a great deal of beauty effect (FIG. 2). Furthermore, in the embodiment, since the clock body 10 can be designed in a thin type and a small size, as shown in FIG. 2, and a battery 85 (a pen light type in the embodiment) to drive the rotor 32 can be contained in parallel with the clock plate 30 and the supplementary plate 84, the clock body 10 can be further designed in a thin type and a small size.

In this embodiment, the linked arrangement of the clock drive gear train with the additional pendulum drive gear train enables the spring 72 to be automatically wound up for accumulation of the urging force by the clock drive gear train when the clock is started. The wind-up action accumulates and stores the self-starting energy in the spring 72, and the clock body 10 can be self-started when the clock is started.

In the embodiment, the normal rotation of the time correcting wheel 74 cannot only correct a time of the clock but also wind up and accumulate the initial urging force. In other words, since the intermediary wheel pinion 76 of the time correcting wheel 74 is geared with the minute hand wheel 40 and the intermediary wheel 78 of the time correcting wheel 74 is further geared with the transmission wheel pinion 82 of the transmission wheel 70, the normal rotation of the time correcting knob 86 by manual operation cannot only revolve the minute hand wheel 40 to correct a time of the clock but also the rotation of the intermediary wheel 78 winds up the spring 72 and provides the spring 72 the initial urging force. The rotation of the time correcting wheel 74 can therefore provide the initial urging force to the spring 72, and thereis an advantage that the clock body 10 can perform good start of swing.

Figure 4:
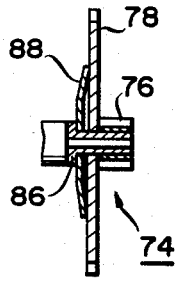
FIG. 4 is an illustration showing a slip mechanism installed with a time correcting wheel.

Furthermore, in this embodiment, a slip mechanism is installed with the time correcting wheel 74. In FIG. 4, shown therein is the slip mechanism.

In FIG. 4, the intermediary wheel pinion 76 is pressed and attached onto a shaft 86 of the time correcting wheel 74 and the intermediary wheel 78 is freely installed between the shaft 86 and the intermediary wheel pinion 76. Since a spring 88 is inserted between the shaft 86 and the intermediary wheel 78, and the intermediary wheel pinion 76 and the intermediary wheel 78 are resiliently coupled by the spring 88, the intermediary wheel 78 is composed so that the intermediary wheel 78 can slip off from the intermediary wheel pinion 76 when the torque exceeds the predetermined degree. Accordingly, when the time is corrected by the rotation of the time correcting wheel 74, the transmission wheel as well as the minute hand wheel 40 rotates to wind up the spring 72 to accumulate the urging force. At this time, when the torque is provided to the spring 72 exceedingly to the predetermined torque, the slip mechanism mentioned above slips the intermediary wheel 78 off from the intermediary wheel pinion 76, and the spring 72 can be prevented from the addition of the torque exceeding the predetermined torque. The spring 72 can be thus prevented from destruction and damage.

Furthermore, the slip mechanism mentioned above is also applied to the third wheel 38. In other words, the third wheel 38 is composed so that it can slip to rotate off from the third wheel pinion 52 by means of a spring 90. Therefore, when the time is corrected by the rotation of the time correcting wheel 74, the rotor 32 can be prevented from overload transmission from the minute hand wheel 40.

The preferred embodiment of the present invention is composed as described heretofore, and its operation is hereinafter described.

At first, when the clock is started, the minute hand wheel 40 and the hour hand wheel 60 are rotated by the manual operation of the time correcting wheel 74 and the time is thus corrected. The rotation of the time correcting wheel 74 winds up the spring 72 to accumulate the urging force. For example, the minute hand movement in the 15 minute distance provides the sufficient swing start capability. At this time, as described above, the time correcting wheel 74 has the slip mechanism, and the spring 72 is not provided the torque exceeding the predetermined torque.

After the preparation of the clock start is thus completed, the rotor 32 rotates by the electric current supplied from a power source. The rotation of the rotor 32 is reduced and transmitted to the minute hand wheel 40 through the fifth wheel 34, the fourth wheel 36 and the third wheel 38. The rotation of the minute hand wheel 40 and the hour hand wheel 60 further revolves the minute hand 42 and the hour hand 44 to indicate a certain time. Furthermore, the rotation of the minute hand wheel 40 is increased and transmitted to the transmission wheel 70 through the time correcting wheel 74 and the spring 72 is wound up. This spring 72 provides the predetermined rotating force to the escape wheel 62. The swing movement of the additional pendulum 22 (the pallet fork 64) is hereinafter described in reference to the drawings of FIGS. 1, 5 and 6.

Figure 5:
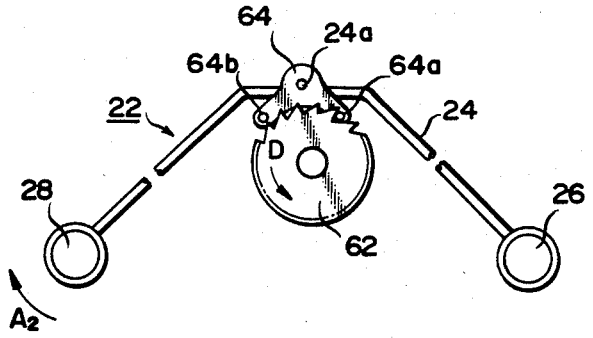
FIGS. 5 and 6 are illustrations showing a state of engagement between an escape wheel and a pallet fork.
Figure 6:
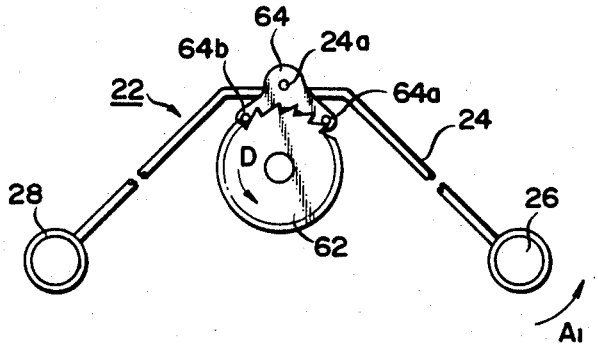

In FIGS. 5 and 6, the pallet fork 64 is swingingly supported on the additional pendulum fulcrum **24*a*, and the escape wheel 62 is urged toward the direction of arrow D by the urging force of the spring 72. The pallet fork pins 64*a* and 64*b* are geared with the escape wheel 62**.

When the clock body 10 is put in the state as is shown in the two dot chain line $C_2$ in FIG. 1, the additional pendulum 22 swings to keep the balance to the gravity. In other words, as shown in FIG. 5, the geared conditions between the escape wheel 62 and the pallet fork pins **64*a* and 64*b* of the pallet fork 64 connected to the additional pendulum 22 change so that the pallet fork pins 64*a* is geared with the escape wheel 62 and the pallet fork pin 64*b* is released from the escape wheel 62 to have the escape wheel 62 to be advanced by one tooth. At this time, since the escape wheel 62 is provided the rotating force to the direction of arrow D, the pallet fork 64 is provided the swing urging force and the singing movement of the additional pendulum 22 is increased to the direction of arrow $A_2$. The clock body 10** is thus urged in its swinging movement.

When the clock body 10 swings back to the state as is shown in the two dot chain line $C_1$ in FIG. 1, the additional pendulum 22 swings to keep the balance to the gravity. In other words, as shown in FIG. 6, the geared conditions between the escape wheel 62 and the pallet fork 64 changes so that the pallet fork pin 64*a* is released from the escape wheel 62 and the pallet fork pin 64*b* is geared with the escape wheel 62 to have the escape wheel 62 to be advanced by one tooth. At this time, since the escape wheel 62 is provided the rotating force to the direction of arrow D, the pallet fork 64 is provided the swing urging force and the clock body 10 is urged in its swinging movement in the same action mentioned above.

Accordingly, in the additional pendulum drive mechanism of the embodiment, since the escape wheel 62 is provided the rotating force to the direction of arrow D by the spring 72, the escape wheel 62 can provide the swing urging force to the pallet fork 64, whereby the energy loss caused by friction or the like can be offset. Due to the fact mentioned above, the swing movement of the additional pendulum 22 is always performed so normally that the swing movement of the clock body 10 can be also continued on.

As mentioned heretofore, according to the embodiment, the liked arrangement of the clock drive gear train with the additional pendulum drive gear train enables the urging means in the additional pendulum drive mechanism to be wound up for accumulation of the urging force by the clock drive gear train and makes it possible that both of these two gear trains are driven by the single drive means. The clock body can be, therefore, designed in a thin type and a small size. Moreover, both of these two gear trains mentioned above are supported their shafts on the one side by the clock plate and the supplementary plate covers over the open side. Accordingly, it is further possible to accomplish the design of the clock body in a thin type and a small size. The above mentioned supplementary plate consists of a transparent plate composing a clock dial plate. Since both of these two gear trains are made of metal and can be seen through the supplementary plate (the transparent plate) from the outside, a user can enjoy a novel design as well as a great deal of beauty effect.

In this embodiment, since the time correcting wheel is prepared between the clock drive gear train and the additional pendulum drive gear train so that it can be geared with both of these two gear trains, the rotation of the time correction wheel cannot only correct a time of the clock but also wind up the urging means of the additional pendulum drive mechanism to accumulate the initial urging force, and the clock body can perform good start of swing when the clock is started. Furthermore, since the time correcting wheel is prepared with the slip mechanism, when the time correcting wheel is rotated, the slip mechanism can prevent the urging means of the additional pendulum drive mechanism from being provided the urging force exceeding the predetermined urging force. The slip mechanism can therefore prevent the urging means from destruction and damage and makes it possible to always provide the urging means a fixed urging force.

Moreover, in this embodiment, the transmission wheel is established so that it can rotate in a higher speed than the minute hand wheel 40. The spring 72 is wound up once every 20 seconds. The escape wheel 62 is advanced by one tooth, and rotates once every 40 seconds. This escape wheel 62 is geared with the pallet fork pins 64*a* and 64*b* to swing the pallet fork 64 at two second interval. The spring 72 is established so that it can be wound up faster than it can be rewound.

In order to correct a time of the clock, an exclusive wheel is prepared to gear with the minute wheel and this exclusive wheel is rotated in the prior art device. In the embodiment, however, the time correcting wheel 74 is prepared to increase and transfer the rotation of the minute hand wheel 40 to the transmission wheel 70, and the rotation of this time correcting wheel 74 can correct a time of the clock. Accordingly, the exclusive wheel prepared for time correction in the prior art device is not required, and this embodiment can enjoy a simple composition.

As described heretofore, according to the present invention, the linked arrangement of the clock drive gear train with the additional pendulum drive gear train enables the urging means in the additional pendulum drive gear train to be wound up for accumulation of the urging force by the clock drive gear train, and makes it possible that both of these two gear trains are driven by the single drive means. Accordingly, it is possible to provide the whole body swingable clock in which the clock body can be designed in a thin type and a small size.

What is claimed is:

1. A whole body swingable clock comprising:

a clock body swingingly supported on the pendulum fulcrum;

an additional pendulum contained in said clock body to swing said clock body by means of movement of gravity center position;

said clock body containing a clock drive mechanism having a clock drive gear train to indicate a certain time and containing an additional pendulum drive mechanism having an additional pendulum drive gear train to drive said additional pendulum;

said additional pendulum drive gear train prepared with an escape wheel, a pallet fork which engages with the escape wheel to swing and is connected to said additional pendulum and a urging means which provides the predetermined rotating force to the escape wheel so that the rotation of the escape wheel enables the engaging conditions between the escape wheel and the pallet fork to be changed to swing the pallet fork and said addtional pendulum connected thereto and further the whole clock body;

wherein said clock drive gear train and said additional pendulum drive gear train are arranged to be linked with each other so that said clock drive gear train can wind up said urging means to accumulate the urging force, and both of two gear trains can be driven by a single drive means.

2. A whole body swingable clock according to claim 1, wherein both of said two gear trains are supported the shafts on their one side by the clock plate and a supplementary plate covers over their open side.

3. A whole body swingable clock according to claim 2, wherein said supplementary plate consists of a transparent plate comprising a dial plate of the clock and both of said two gear trains can be seen through from the outside of said transparent plate.

4. A whole body swingable clock comprising:

a clock body swingingly supported on the pendulum fulcrum;

an additional pendulum contained in said clock body to swing said clock body by means of movement of gravity center position;

said clock body containing a clock drive mechanism having a clock drive gear train to indicate a certain time and containing an additional pendulum drive mechanism having an additional pendulum drive gear train to drive said additional pendulum;

said additional pendulum drive gear train prepared with an escape wheel, a pallet fork which engages with the escape wheel to swing and is connected to said additional pendulum and a urging means which provides the predetermined rotating force to the escape wheel so that the rotation of the escape wheel enables the engaging conditions between the escape wheel and the pallet fork to be changed to swing the pallet fork and said additional pendulum connected thereto and further the whole clock body;

wherein a time correcting wheel is installed between said clock drive gear train and said additional pendulum drive gear train so that said time correcting wheel can be geared with both of said two gear trains, and the rotation of said time correcting wheel enables a time to be corrected and said urging means of said additional pendulum drive mechanism to be wound up for accumulation of the initial urging force.

5. A whole body swingable clock according to claim 4, wherein said time correcting wheel is installed with a slip mechanism which prevents said urging means of said additional pendulum drive mechanism from being provided a urging force exceeding a predetermined urging force when said time correcting wheel is rotated.

* * * * *